United States Patent [19]

Carter et al.

[11] Patent Number: 4,702,381

[45] Date of Patent: Oct. 27, 1987

[54] TOWEL PROTECTOR

[76] Inventors: Ransom M. Carter; Ophelia L. Carter, both of 2219 Penrose Ave., Baltimore, Md. 21223

[21] Appl. No.: 11,014

[22] Filed: Feb. 5, 1987

[51] Int. Cl.[4] ..... A47F 5/08

[52] U.S. Cl. ..... 211/105.2; D6/546; 211/123

[58] Field of Search ..... 211/105.2, 123, 124, 211/87; 223/87, 88, 91, 98; D6/546, 547, 549, 550

[56] References Cited

U.S. PATENT DOCUMENTS

| | | | |
|---|---|---|---|
| D. 248,910 | 8/1978 | DeFilippo | D6/137 |
| D. 261,337 | 10/1981 | Fink | D6/99 |
| 2,470,811 | 5/1949 | Engelman | D6/546 X |
| 3,301,446 | 1/1967 | Braswell | 223/98 |

*Primary Examiner*—Robert W. Gibson, Jr.
*Attorney, Agent, or Firm*—John F. McClellan, Sr.

[57] ABSTRACT

A system for displaying but protecting while displaying bath and hand and kitchen towels and the like provides for use with a towel bar over which a towel is deployed in the usual manner, a protector or protective cover, size-matched to the towel bar preferably. The system reminds absentminded and careless people not to use towels covered, while keeping the towels on display and ready for instant use. The protective cover has a flat panel with an integral uniformly covered end forming a 180° hook that for self-adjusting and visibility purposes has a uniform radius suited for encompassing one or, if desired, more towels folded over the towel bar. The proportion of hook and panel and bar permits the entirety of a towel or towels to be covered, and provides stability if the cover is stored temporarily on the rack without a towel, or with a towel over it instead of under it. Transparency of the cover permits ready ascertainment of whether a towel is covered, and, if so, the freshness of the towel and color and ornamentation, size and other aspects of it. Engraved or other indicia on the cover may be used for identification of the particular type or purpose of the towel protected.

6 Claims, 3 Drawing Figures

TOWEL PROTECTOR

FIELD OF THE INVENTION

This invention relates generally to protective systems and specifically to a system for protecting fine towels while keeping them ready for immediate use.

BACKGROUND OF THE INVENTION

Fine towels, or launder and re-use towels, as opposed to one-use towel, can present a problem in any household where absent-minded or careless users, including but not limited to young children, tend to wipe hands on any towel that is hung, ready for use. Such users forget that certain towels hanging in a powder room or a bath may be reserved for guests and are to be kept clean and unused until guests arrive. And even though the guest may be understanding, towels with even small amounts of grease, make-up, candy and other material, small amounts of which may spoil the freshness of a towel, can extend an unwelcoming feeling to visitors.

In the prior art known, fine towel protectors are not known to have been disclosed in accordance with the present invention. The following U.S. patents show some possible relation to the general field of the invention.

U.S. Pat. No. Des. 261,337 issued to R. W. Fink on Oct. 20, 1981 showed a hook-shaped frame that is hung over a towel rack bar and can evidently be hung over a towel on the bar. A towel could be seen through the open frame.

U.S. Pat. No. Des. 248,910 issued to F. DeFillippo on Aug. 15, 1978 showed a hook-shaped sheet member that could be hung over a towel and would, if made transparent, permit the towel to be seen through it.

SUMMARY OF THE INVENTION

In brief summary given as cursive description only and not as limitation, as a protector against needless use of a reserved towel, the invention includes a flat panel with an integral, rounded hooked first end forming a protector for hanging over a towel on a towel rack proportioned for holding a towel that can be covered laterally by the protector. The protector is also long enough on the front face for the second end to cover the length of the outer fold of a towel and is shorter on the rear face for quick detachment and good ventilation, and preferably is transparent for ready identification of a towel covered and for viewing the towel and observing the color, decoration, size and other characteristics.

Further objects are to provide a system as discussed that is practical, is easy and economical to make, ship, sell and use, that is attractive and light in weight, that can be stored in place on a rack when not in use, and that can be used in more than one way.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
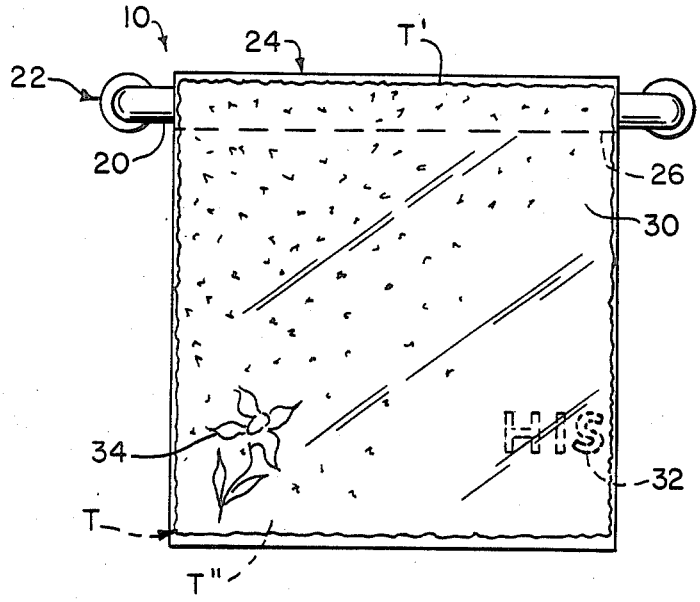
FIG. 1 is an elevational view of the preferred embodiment of this invention in use with a towel, showing best mode.
Figure 2:
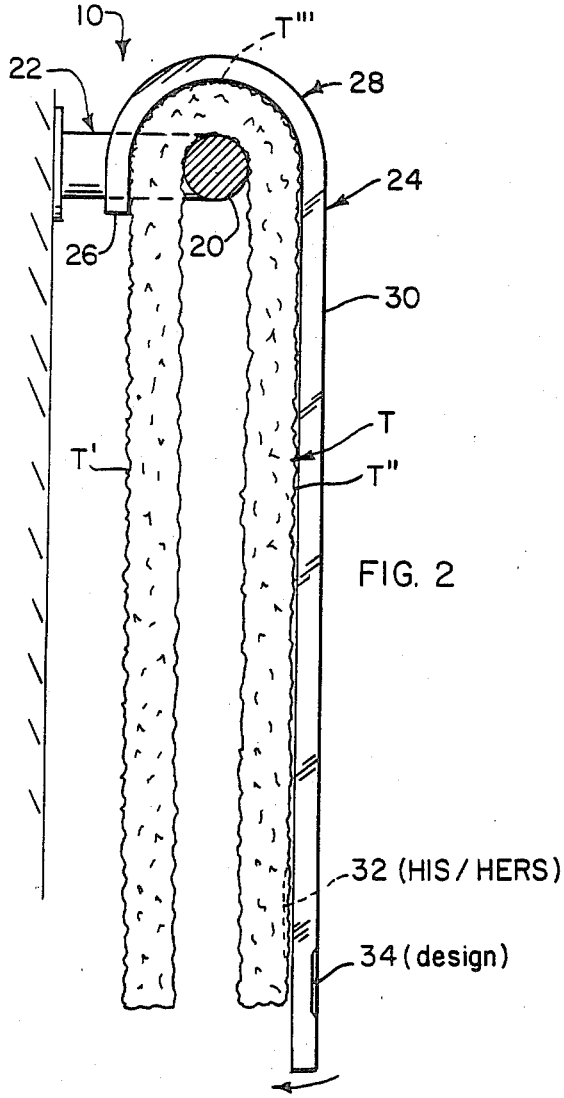
FIG. 2 is a side elevational view thereof with a wall position to which mounted indicated.

FIGS. 1 and 2 show a towel T protected by a preferred embodiment 10 of this invention. The invention may include, as an example, any horizontal towel bar 20 such as that on wall-mounted towel rack 22 indicated.

The towel T to be protected may be folded over or looped over the bar in a conventional manner so that respective portions T′, T″ of it hang down substantially equally at front and the back.

There is some protective overhang at the back as well, at the terminal margin 26 of the hook-shaped first end 28 that describes a 180° return with the substantially short part 26 downwardly projecting therefrom in the rear parallel with the front panel 30 of the protector. With the center of the radius describing the 180° return centered generally on the towel bar 20, the protector is self-centering. This arcuate feature also, with center of gravity offset to the front, tends to swing to the rear, the lower front portion of the towel end applies a pressure (arrow) to keep the towel and protector swung back toward the rear.

It can be seen that the system in the preferably transparent embodiment 10 displays the towel to advantage, showing color, design or indicia usually woven into the material as at 32, and freshness or cleanliness, and type toweling.

The towel protector 24 may have one or more ornamental or instructive designs 34 on it, preferably engraved or molded in it.

In use, therefore, the towel is both identified and protected so that heedless people are cautioned not to use it and a housewife can be assured that the towel will remain fresh until put in use by her. To put the towel into use she simply lifts-off the towel protector 34. She may store the towel protector in any convenient place.

Figure 3:
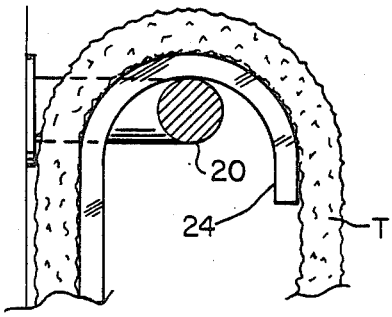
FIG. 3 is a view similar to that of FIG. 2 but fragmentary and showing another mode of use.

FIG. 3 shows another way to use the towel protector 24 or to store it. It may be hung over the bar 20 until needed, and if desired, a towel T may be hung over the exterior of the protector, in which case the towel can be used as it hangs. For compactness and for storage and to leave access to both sides of the front face of the towel if a towel is on it, the towel protector may be reversed on the bar as shown.

Material for the system can be any desired construction material for the towel rack, a cylindrical bar of ½ inch (3 mm) diameter by 24 inches (60 cm) length, being preferred with a standard clearance fom the wall of at least 2 inches (5 cm).

"Plexiglass" brand methylenethracylate transparent sheet is preferred for the protector. This may be ⅛ inch (3 mm) thick by 20 by 23 inches (50 by 54 cm) and may be thermally bent at the first or upper end into a 180° smooth arc with a radius of about 1 to 2 inches (2.5 to 5 cm) and with the terminal end returned for a distance of ½ inch (13 mm) parallel with the flat sheet portion.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for protecting a hung towel from use by a careless or absent-minded user, characterized by the combination of a horizontal bar for a towel to be hooked over so that the towel hangs down in front and at the rear, a protector with integral first part and second part, means for hanging the protector over the towel on the horizontal bar, said second part proportioned for thereby extending downwardly from the first part and covering the front of the towel, and said first and second parts laterally extending substantially the width of and covering the horizontal bar.

2. A system as recited in claim 1, and means for causing self-adjusting in the hanging of the protector and causing the protector to press against and keep toward the rear a lower portion of the towel.

3. A system as recited in claim 2, the means for hanging the protector comprising a hook-shape on the first part.

4. A system as recited in claim 3, the means for causing self-adjusting comprising the hook-shape having a uniform radius and the second part comprising a substantially long towel-covering panel extending down from a portion of the hook-shape.

5. A system as recited in claim 4, means for inspecting a towel protected by the protector, comprising the protector being transparent.

6. A system as recited in claim 5, the protector having in a surface thereof a decoration.

* * * * *